US006114807A

United States Patent [19]

Kavanagh

[11] Patent Number: 6,114,807

[45] Date of Patent: Sep. 5, 2000

[54] LIGHT SOURCE IN THE FORM OF AN ARC LAMP, A SEALED BEAM LIGHT SOURCE, A LIGHT SOURCE INCLUDING A REFLECTOR AND A MOUNTING MEANS

[75] Inventor: Martin Kavanagh, Oldham, United Kingdom

[73] Assignee: Digital Projection Limited, Manchester, United Kingdom

[21] Appl. No.: 09/005,730

[22] Filed: Jan. 13, 1998

Related U.S. Application Data

[63] Continuation of application No. 08/356,303, filed as application No. PCT/GB93/01264, Jun. 14, 1993, abandoned.

[30] Foreign Application Priority Data

Jun. 15, 1992 [GB] United Kingdom ..... 9212675
Dec. 15, 1992 [GB] United Kingdom ..... 9226152

[51] Int. Cl.[7] ..... H01J 17/20

[52] U.S. Cl. ..... 313/570; 313/573; 313/574; 313/631; 313/634

[58] Field of Search ..... 313/570, 573, 313/574, 618, 631, 632, 633, 634, 636, 113, 116; 362/263, 264, 268, 296, 297

[56] References Cited

U.S. PATENT DOCUMENTS

| | | | |
|---|---|---|---|
| 3,113,234 | 12/1963 | Schlegel | 313/570 |
| 3,644,768 | 2/1972 | McRae | 313/113 |
| 3,881,132 | 4/1975 | Miller | 313/344 |
| 3,934,166 | 1/1976 | Stuart | 313/356 |
| 3,988,626 | 10/1976 | Boudouris | 313/113 |
| 4,633,128 | 12/1986 | Roberts et al. | 313/570 |

*Primary Examiner*—Vip Patel
*Attorney, Agent, or Firm*—Dean W. Russell; Michael J. Turton; Kilpatrick Stockton LLP

[57] ABSTRACT

An arc lamp suitable for use as a high intensity light source in a projection system is described. A reflector is arranged to reflect the light produced by the arc into a directional light beam, secondary reflection means being arranged to direct part of the reflected beam so as to compensate for regions which are obscured by the electrodes. Means are provided within the light source to dissipate heat generated by the electrodes.

11 Claims, 10 Drawing Sheets

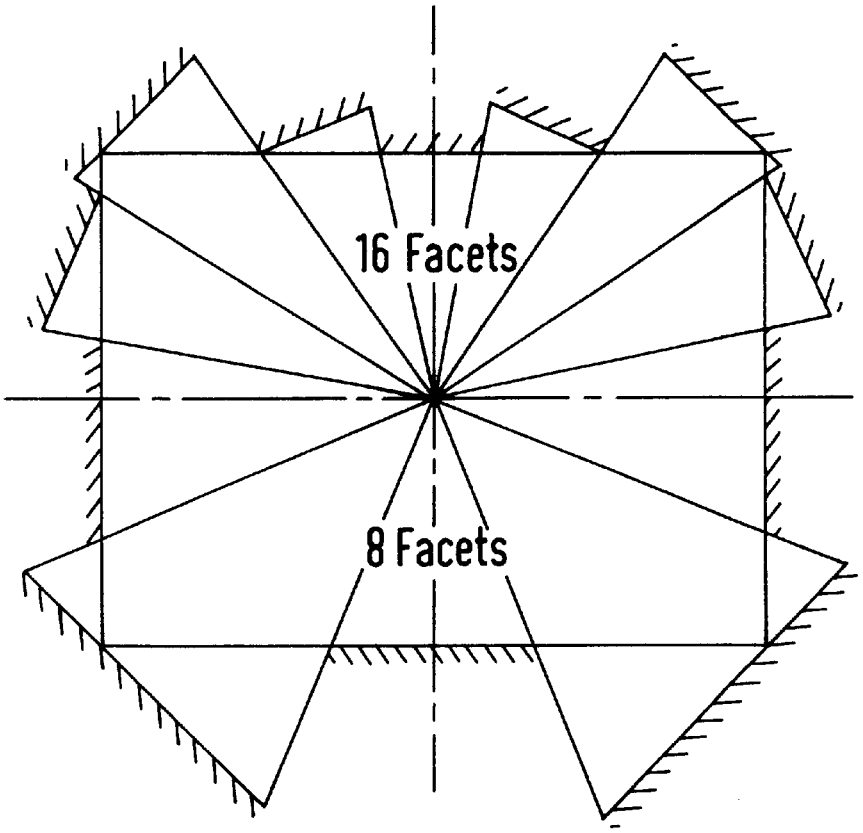
FIG. 6A
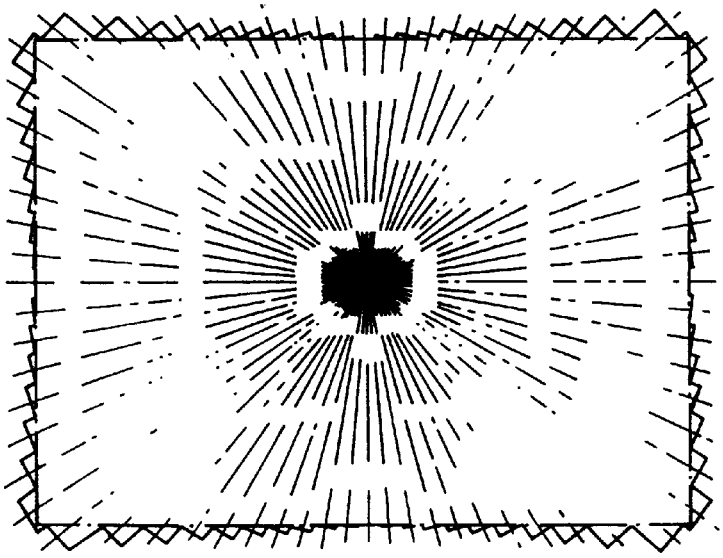
FIG. 6B 72 Facets

LIGHT SOURCE IN THE FORM OF AN ARC LAMP, A SEALED BEAM LIGHT SOURCE, A LIGHT SOURCE INCLUDING A REFLECTOR AND A MOUNTING MEANS

This is a continuation of application Ser. No. 08/356,303 filed Jan. 27, 1995 now abandoned which is a 371 of PCT/GB93/01264 filed Jun. 14, 1993.

BACKGROUND OF THE INVENTION

1. Field of the Invention

The present invention relates to a light source and, particularly, to a high intensity light source for use in a projection system.

The invention has particular application to light sources for use with spatial light modulator devices.

A spatial light modulator is an optical device which is controllable so as to modulate an incident light beam. Colour spatial light modulators are known in which beams of different colours are reflected from different spatial light modulator devices, each driven in accordance with a different video signal. The coloured modulated beams are then combined to form a single projected colour display.

2. Description of the Prior Art

One known type of light modulators is an active matrix device, comprising a matrix of individually addressed pixels in the form of light valves or modulators. A system having an array of liquid crystal light modulators is described in EP-A-0401912 in which light is variably transmittable through each element of the array which in turn modulates the amplitude of the light passing through that element.

A tiltable mirror device is disclosed in U.S. Pat. No. 4,856,863, which shows devices having miniature mirrored elements, wherein each element includes electrodes and is arranged to be electrostatically deflectable between two positions, the extent of deflection being controllable by the extent of the applied electrostatic potential. Such devices may also be operated in a binary mode, in which each mirrored element is arranged to switch between two discrete deflection states, so as to reflect incident light into either a first position or a second position, so as to represent light or dark in the final output beam.

Using a tiltable mirror device, as each mirrored element is individually addressable, a two dimensional image can be reproduced by exposing the array to an incident light beam, modulating the incident beam by controlling the individual mirror devices from a video signal and collating the beam reflected in a particular direction. The small size of the mirrored elements, together with their very fast switching times, allows the elements to be operated at video rates, facilitating the display of a real time video image.

The incident beam does not scan the array, in the way in which an electron beam scans in a cathode ray tube, but is arranged to illuminate the entire device. Thus, given that a high intensity output is desirable in a projection system, it is desirable to illuminate the device with a high intensity beam. A system of this type is described in international application WO91/15843, assigned to the present assignee.

Not only must a high intensity beam be supplied to the array of devices, but the beam must be substantially uniform and be generated by a compact light generating means, in order that the overall dimension of the projection device be manageable.

A compact high intensity light source is manufactured by ILC Technology Inc. of California U.S.A. consisting of a compact xenon arc lamp, arranged to operate with an input power supply of one killowatt to produce a two inch diameter beam.

Much of the radiated energy produced in such a device cannot be used, either because it cannot be focused into the beam or because it does not lie within the visible spectrum. In order to increase the power output, it would be possible to increase the power input. There is, however, a limit to the amount of power which may be supplied to the device, due to electrode wear, overheating and general saftey constraints.

It is an object of the present invention to provide an improved light source. It is a further object of the present invention to provide an improved light source having improved light efficiency. It is a further object of the present invention to provide an improved light source with improved heat dissipation. Furthermore, it is an object of the present invention to provide an improved light source arranged to operate with an increased power input.

Another problem with known light sources is that the beam tends not to be uniform across its diameter. In particular, a central hole is often present due to the presence of the arc generating electrodes which obscure light as it is reflected back from an associated reflector.

When operating over larger distances, beam divergence ensures that the central hole is filled in and, when the light source is used as a searchlamp for example, no noticeable hole is present and the distribution of light across the beam width appears substantially Gausian. However, at short distances, such as those present in projection systems, the presence of the hole is noticeable and the distribution of light across the beam diameter is noticably non-isotropic.

SUMMARY OF THE INVENTION

According to an aspect of the present invention, there is provided a light source comprising light generating means, and a reflector arranged to reflect light from the generating means into a directional light beam, wherein said beam is not uniform due to part of the reflector being obscured by the generating means, characterised by secondary reflection means arranged to direct part of the reflected beam so as to compensate for the obscured region.

Preferably, the secondary reflector consists of an annular reflector arranged to reflect peripheral light from the edge of a beam in a direction normal to the axis of propagation and a conical reflector centrally positioned so as to redirect said normal beam into the direction of propagation.

Another problem with known arc light sources is that, although they may operate at reasonable voltages during steady state operation, a very high voltage may be required to initiate discharge. This creates problems in that additional equipment must be provided for generating the initial start up voltage and, furthermore, measures must be taken to protect other equipment from the effects of such a high voltage.

According to another aspect of the invention, there is provided a light source comprising an anode, a cathode and an electrical power source for creating an arc between said anode and cathode, characterised in that said anode and cathode are enclosed within a local atmosphere and a radio active source is introduced to ionise the enclosure, thereby reducing the level of an initial voltage required to initiate the arc.

A suitable radio active source may be included in or on the anode or the cathode. Alternatively, a radio active source may be included in the material of an associated reflector if said reflector is enclosed within the arc source.

Other aspects of the invention will become apparent from the description of the embodiments, hereinafter described.

BRIEF DESCRIPTION OF THE DRAWINGS

A number of embodiments in accordance with the invention will now be described, by way of example only, with reference to the accompanying drawings in which:

FIGS. 6*a* and 6*b* show faceted parabolic reflectors which may be incorporated in a light source in accordance with the invention;

DESCRIPTION OF THE PREFERRED EMBODIMENTS

Figure 1:
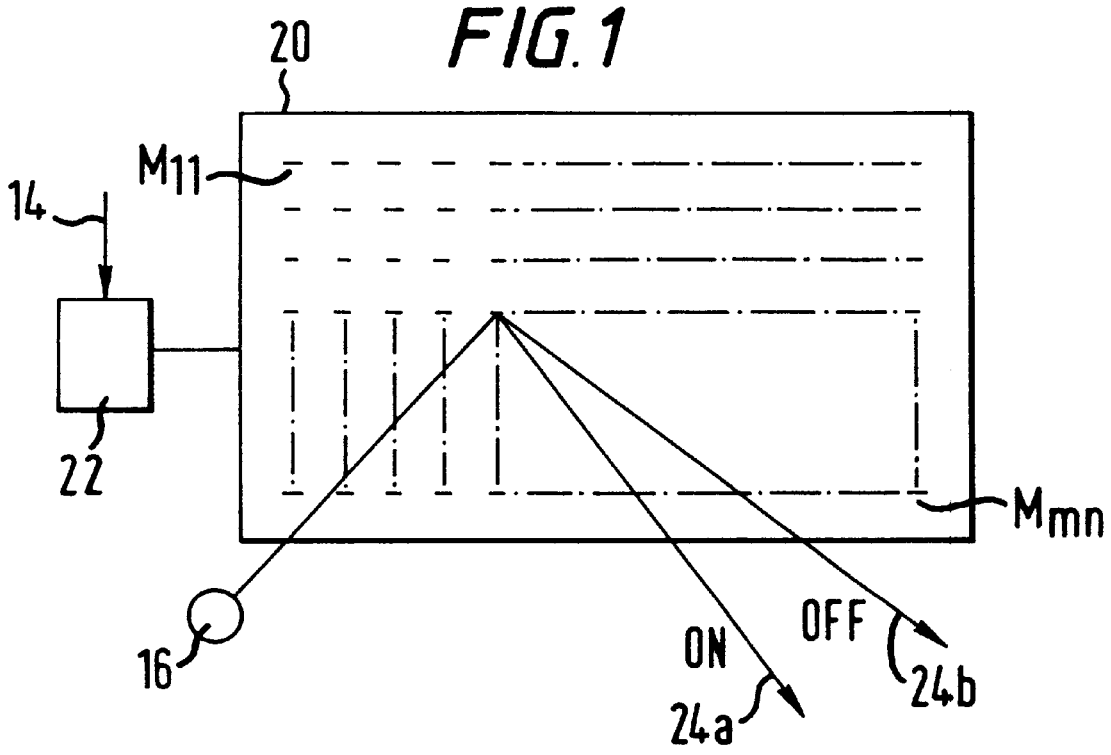
FIG. 1 shows schematically the structure of a spatial light modulator device.

A tiltable mirror device array is shown in FIG. 1, consisting of an array of tiltable mirrors.

An array 20 is connected to an addressing circuit 22, arranged to receive a colour signal from a processing circuit 14. The addressing circuit 22 addresses each of the respective reflectors, as described in international application PCT/GB92/00002, assigned to the present Assignee (incorporated herein by reference). Each reflector is operated between one of two reflection states, which result from the reflector being positioned in one of two possible positions. In an "on" state the reflected light, from a source 16, is directed along a first path 24*a*, while in an "off" state the light from said source is directed along a second path 24*c*. The second path 24*c* lies in a direction away from subsequent optical components of the system, the light passing into a beam dump (not shown). When viewed along the "on" path 24*a*, the array 20 displays a two dimensional image, in which modulators set to a first reflection state appear bright, while those set to a second reflection state appear dark.

Figure 2:
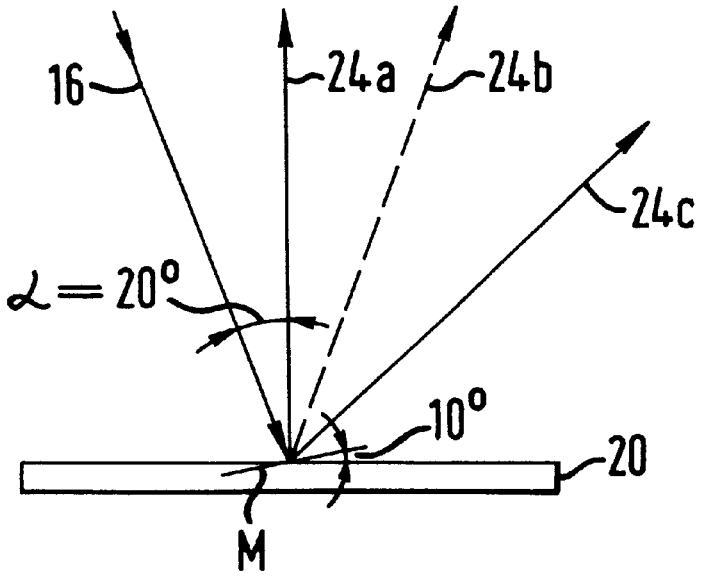
FIG. 2 shows schematically the optical illumination of a portion of the device shown in FIG. 1.

The angle through which each reflector is deflected, between its two operating states is detailed in FIG. 2. The angle of deflection is relatively small therefore, in order to achieve good discrimination between the two states, the incident light beams from the source 16 is directed towards the array 20 at an angle of 20 degrees from the normal to the display.

When an individual reflecting device M is lying in a non-operational mode parallel to the plane of the array 20, the incident beam is reflected at a corresponding angle of 20 degrees to the normal along the "off" path 24*b*. When the control signal from the addressing circuit 22 sets the deflector M into a first controlled reflection state, at an angle to the plane of the array 20, the incident beam is reflected out along the normal to the array along the "on" path 24*a*. When the reflector is set to a second controlled reflection state at an angle to the plane of the array, the incident beam is reflected out along path 24*c* at 40 degress to the normal in a further "off" path into the beam dump.

Figure 3:
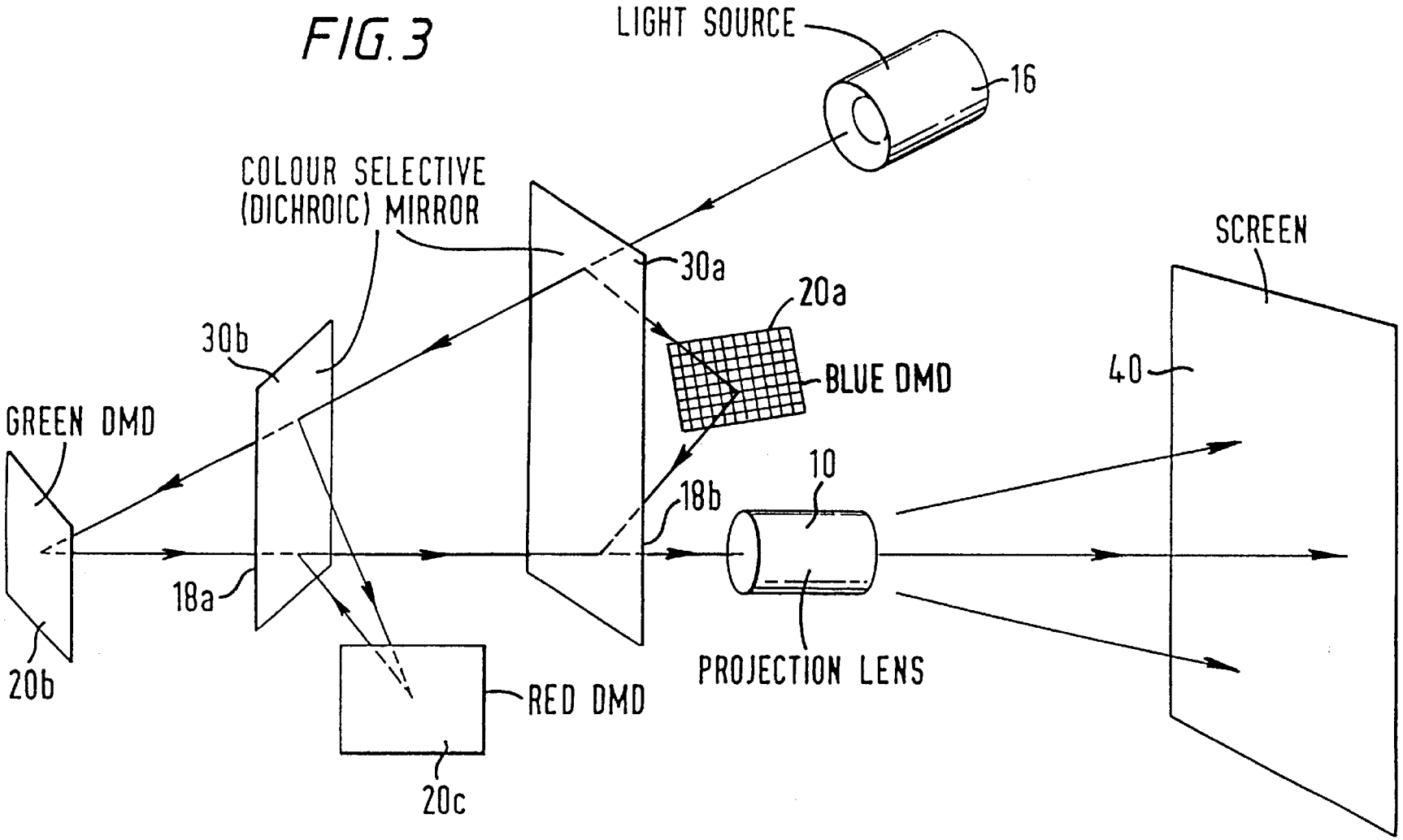
FIG. 3 shows schematically an optical colour projection display system, including three modulator devices of the type shown in FIG. 1, and illuminated by a light source.

In operation and as shown in FIG. 3, a high power light source 16 is provided which generates light along an incident light path which is, for example, in a plane normal to that of a display screen 40. For example, the light source 16 may be positioned above the display screen 40. A planar deformable mirror display device 20*b* is positioned in a plane parallel to the screen and the light source 16 is arranged to illuminate deformable mirror display device 20*b* at an angle of 20 degrees to its normal axis. The array 20*b* is arranged to deflect the incident beam to illuminate the screen 40 via a projection lens 10.

Positioned within the path of the incident and reflected beams are a pair of splitter/combiner mirrors 30*a*/18*b*, 30*b*/18*a* which are at an inclination, rotated about the vertical axis relative to the plane of the screen by an angle of between 20 and 70 degrees, preferably at 45 degrees, so as to reflect the incident beam to further deformable mirror reflector arrays 20*a*, 20*c*.

The arrays 20*a*, 20*b*, 20*c* are positioned at a distance such that the optical path traversed from each array 20*a*, 20*b*, 20*c* to the screen 40 is the same. The first splitter/combiner mirror reflects a blue light component beam onto a deformable mirror display array 20*a* which is modulated in response to the blue colour component of the picture to be displayed. Consequently, the reflected beam is deflected vertically by 20 degrees but is substantially horizontally unmodified. The splitter 30*a*/18*b* transmits red and green wavelength components, substantially unattenuated. The second splitter 30*b*/18*a* reflects red wavelengths to a second deformable mirror device array 20*c*, which is modulated in response to the red colour component signal of the picture to be reproduced and consequently deflected by 20 degrees vertically. The second splitter 30*b*/18*a* allows the green optical wavelengths to pass substantially unattenuated, to be deflected by a third deformable mirror device array 20*b* responsive to the green colour component of the picture to be reproduced.

The modulated green beam passes unattenuated, back through both splitter/combiners, through the projection lens 10 and onto the screen 40. At the first splitter/combiner reached, 18*a*/30*b*, the modulated beam from the red digital mirror device array 20*c* is reflected onto the same path as the modulated green beam and at the second splitter/combiner 30*a*/18*b* the modulated signal from the blue digital mirror device array is reflected back into the same path so that the signal at the projection lens 10 comprises the recombined colour signals.

One of the most important parameters in any image projection system is the intensity of modulated light emitted by the system. The ultimate size of the projected image upon the screen and the permissable degree of ambient light are both directly dependent upon the intensity of light emitted and, consequently it is desirable to emit as much light as possible.

In addition to fabricating modulators capable of modulating high levels of light and to designing efficient dichroic mirrors, a high intensity light source is also required which, in addition to providing a high intensity beam, should also be of modest spatial dimensions, so as not to significantly increase the overall dimensions of the complete assembly.

In addition to having a high intensity, the light beam emitted by the source 16 should also have other properties. For example, the light beam should be uniform over a cross section, and its spectral energy distribution should be concentrated within the visible region, with an appropriate colour bias and shape consistent with its application.

Figure 4:
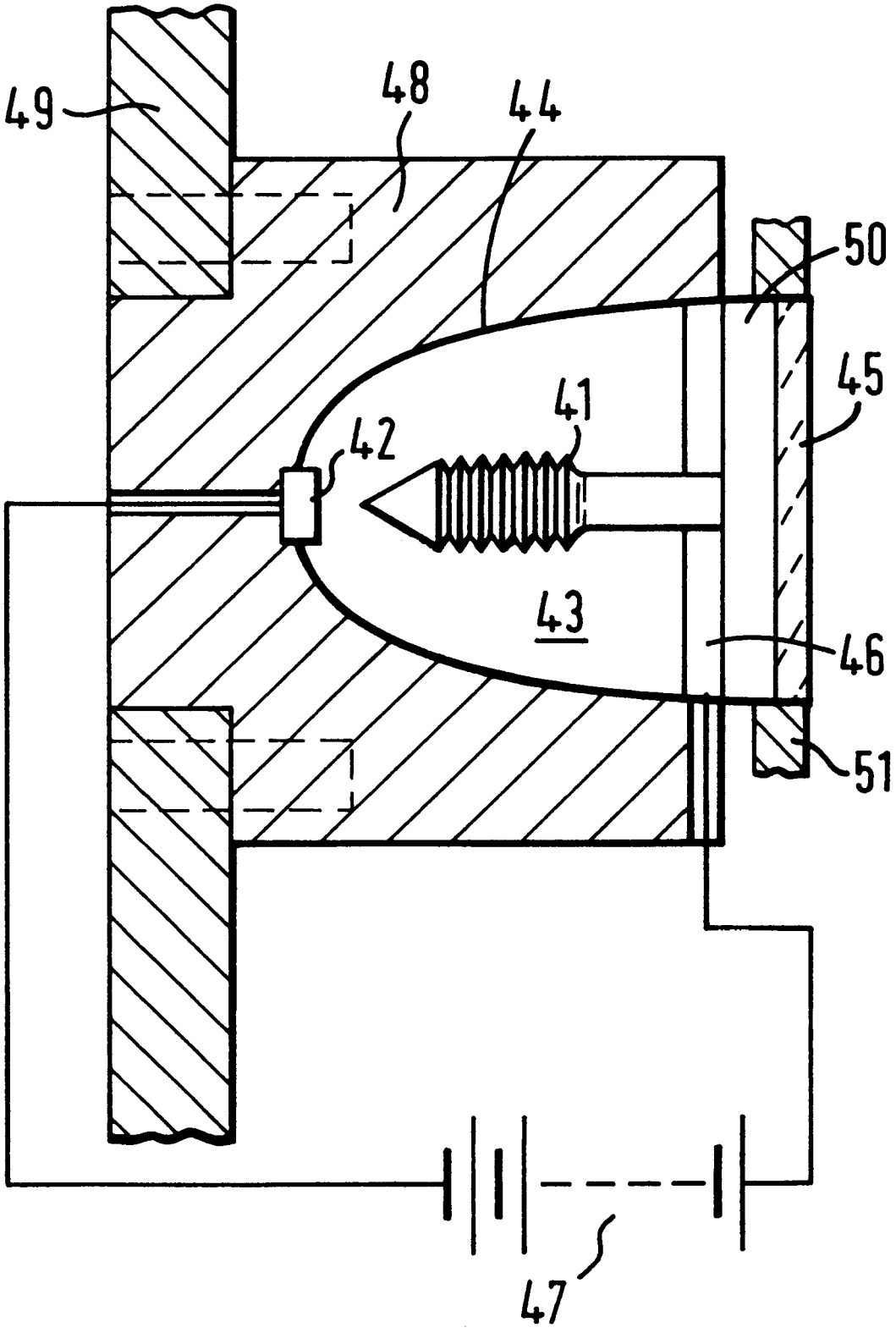
FIG. 4 shows a light source of the type shown in FIG. 3, having a lens forming a sealed window and a parabolic reflector.

A suitable light source 16 is detailed in FIG. 4, in which an arc is struck between a cathode 41 and an anode 42 in a xenon atmosphere 43 enclosed by a parabolic reflector 44 and a light emitting window 45. The cathode 41 is supported by thin cathode supports 46 and connected to a DC voltage supply, illustrated as battery 47. The anode 42 is connected to battery 47 via a line entering through a heat conductive mounting 48 which is in turn mounted on a heat sink 49.

The light source shown in FIG. 4 has been designed to operate at very high power levels, with improved efficiency. A major constraint on operating at high power levels is the removal of heat. As previously stated, the atmosphere 43 within the lamp is predominantly xenon and the arc itself reaches a colour temperature temperature of over 5000 kelvin. The only material capable of operating at these temperatures is tungsten which itself will erode and require replacement. Thus, heat must be removed to reduce tungsten erosion so as to provide a realistic service life between light source replacements.

A further problem with tungsten is that its thermal conductivity characteristics are not good, particularly when compared to high conductivity metals such as copper or silver. The cathode 41 shown in FIG. 4 is not, therefore, constructed from solid tungsten but consists of a tungsten outer shell or cap, with a core, or support, formed from a material of high thermal and electrical conductivity.

In one embodiment, a solid tungsten core is fabricated which is then hollowed out and filled with copper or silver. In addition to providing good heat conduction, the use of copper or silver also provides good electrical conduction, which reduces resistive heating within the cathode.

In an alternative embodiment, a hollow tungsten cathode is filled with a metal or alloy such as sodium, which becomes liquid during use and, having a very high Prandtl number, is even more effective at transporting heat along the length of the cathode.

In a further alternative embodiment, the cathode is fabricated as a copper post with a thin tip, cap or facing of tungsten. This achieves the heat resistance of tungsten at the arc interface coupled with the cooling properties of copper. The post may of course be made of other materials such as copper tungsten or silver.

The cathode 41 essentially loses heat by convection because very little heat is transmitted along the cathode supports 46, which must be kept thin so as not to obscure light reflected from the parabolic reflector 44. In order to improve the rate of heat transfer from the cathode 41 to the surrounding xenon atmosphere 43, the surface area of the cathode 41 is increased by providing a screw-like thread thereon. Alternatively, any other shape or texture may be impressed upon the cathode so as to increase its overall surface area, although it is important that this should not increase the overall diameter of the cathode to an extent that would further obscure light reflected from the reflector 44 and reduce the amount of light output through the light emitting window 45.

It will be appreciated that the reflector 44 may be of another shape rather than parabolic, for example elliptical.

It will also be appreciated that the anode 42 will experience the same problems of overheating as the cathode 41 which can be solved in an equivalent manner as in the cathode 41. As, however, in the embodiment described, the anode 42 is mounted directly into the heat conductive mounting 48, the anode 42 will not generally require convection cooling although the anode 42 has a greater power dissipation requirement than the cathode 41.

In known devices of the type shown in FIG. 4, the heat conductive mounting 48 is commonly fabricated from a ceramic material to facilitate operation at high temperatures. However, such a material has poor heat conduction properties and does not faciliate the transfer of heat from the enclosed atmosphere 43. The use of a ceramic material allows the device to operate at high temperatures, rather than concentrating on removing heat from the operating environment. However, a practical limit exists on the operating temperature, which in turn places a constraint on the operating power of the device.

High velocity turbulance is generated within the parabolic enclosure with heat differentials resulting in optical effects due to refraction. Furthermore, rather than being transmitted through the conductive mounting 48, a large proportion of the heat generated within the parabolic housing is transmitted through the light emitting window and its mountings. Again, this results in temperature differentials being created across the window, which sets up mechanical stresses.

Given the very high operating temperature of the light transmitting window, typically above 150 degrees C., the window must be fabricated from special materials, such as artificial sapphire or fused silica.

In the embodiment shown in FIG. 4, the heat conductive mounting is fabricated from highly heat conductive material such as copper or another metal, so as to remove much of the heat through the reflector 44 before it reaches the light emitting window 45. The anode 42 is fabricated from copper and tungsten and mounted directly onto the copper conductive mounting 48, again facilitating heat removal.

The reflector 44 is fabricated onto the heat conductive mounting. The reflector 44 may be integrated onto the heat conductive mounting by a number of alternative methods, a number of examples of these being given:

(1) A conventional electroformed reflector may be made in conventional manner by electroforming. The heat conductive mounting is then built up by electroplating. The assembly comprising the reflector and heat conductive mounting may then be machined to size.

(2) A conventional reflector may be formed by electroforming, this then being brazed onto a matching piece of metal which becomes the heat conductive mounting.

(3) The required reflector shape may be machined directly into the heat conductive mounting with a precision diamond tool lathe.

(4) A reflector may be formed by precision machining, the heat conductive mounting then being built up by electroplating as in (1) above.

(5) A reflector may be formed by precision machining, this being brazed onto a matching piece of metal which becomes the heat conductive mounting as in (2) above.

(6) A conventional reflector shape may be formed as in (1),(2),(3),(4) or (5) above, the shape then being electroplated with, for example, silver. Finally the plated silver layer is precision machined to form a reflector.

Metallic and/or dichroic coatings may be added to the surface of the reflector 44 to improve performance. Good heat conduction between the tungsten anode 42 and the conductive mounting 48 may be provided as part of the anode cooling path.

Thus accurate radial alignment of the anode with respect to the reflector is provided, with the hole in the reflector being only slightly larger than the diameter of the anode. In assembly of the light source once the anode 42 is fixed in place, it is possible to achieve precise axial alignment of the anode by machining the surface of the anode as long as the thickness of the tungsten facing layer has been appropriately chosen.

In a development of this embodiment, the copper post forming the core of the anode 42 may be made an integral part of a machined heat mounting with the reflector 44 and heat conductive mounting 48 with the tungsten tip being fitted and machined in situ.

As heat convects away from the arc and from the cathode 41, the hot gas is directed towards the upper surface of the reflector 44 which, being formed on the conductive mounting 48, facilitates the fast removal of heat.

A metal flange 50 is provided, essentially to allow the light transmitting window 45 to be mounted to a second heat sink 51. Internally, the metal flange 50 includes axial grooves which, during operation, increases cooling of the circulating gas by keeping heat away from the light emitting window 45. Thus, the overall effect is to reduce the operating temperature of the gas within the parabolic enclosure, and to reduce significantly the operating temperature of and temperature stresses within the light emitting window 45. This improves the lamp integrity and safety during high power operation.

It will be appreciated that whilst in this particular example, the metal flange 50 includes axial grooves, the grooves may also be circumferential or some other form of surface texture finish as described above in relation to the cathode may be used on the metal flange 50 in order to increase the cooling effect of the circulating gas.

Using the techniques identified above for lowering the temperature of the light emitting window 45, it becomes possible to consider modifications to the optical characteristics of said window. As previously stated, the window is fabricated from a material such as artificial sapphire and would normally cooperate with a separate lens for converging the emitted beam, for use with the operating system shown in FIG. 3.

In previous systems, a spherical lens is employed which, from a thermal point of view, has the disadvantage of a non-uniform thickness, being thicker at the centre and thinner at the edges. The known lens is not in physical contact with the window but in close proximity. Hence the lens still gets very hot and needs to be fabricated from a heat resistant material.

It is desirable to reduce the number of optical stages throughout the system, given that each stage or lens will reduce the overall strength of the beam passing since a finite percentage of the beam will be dissipated as heat or reflected.

An optical stage may be removed by replacing the plain light emitting window 45 with a lens of some form. However, problems exist when using a spherical lens, as previously described, given that a thick central region would tend to crack due to thermal stress, whilst a thin peripheral edge will be difficult to mount onto the metal flange 50 and will lack strength.

In a system used for projecting video images, the images tend to be rectangular, rather than square. Thus, it is usual for a circular light beam to be produced which is then passed through an aperture to obtain the desired shape. Such a procedure is wasteful, in that the excluded light is lost and overall operating efficiency is reduced. Efficiency may be improved if, rather than modifying a circular beam, an elliptical beam is modified, preferably with an aspect ratio compatible with that of the video display. Thus, rather than requiring a lens which provides equal strength in all directions, it would be desirable to provide a lens which actually distorts the circular beam into an elliptical beam. Cylindrical lenses are known for achieving this effect.

Figure 5:
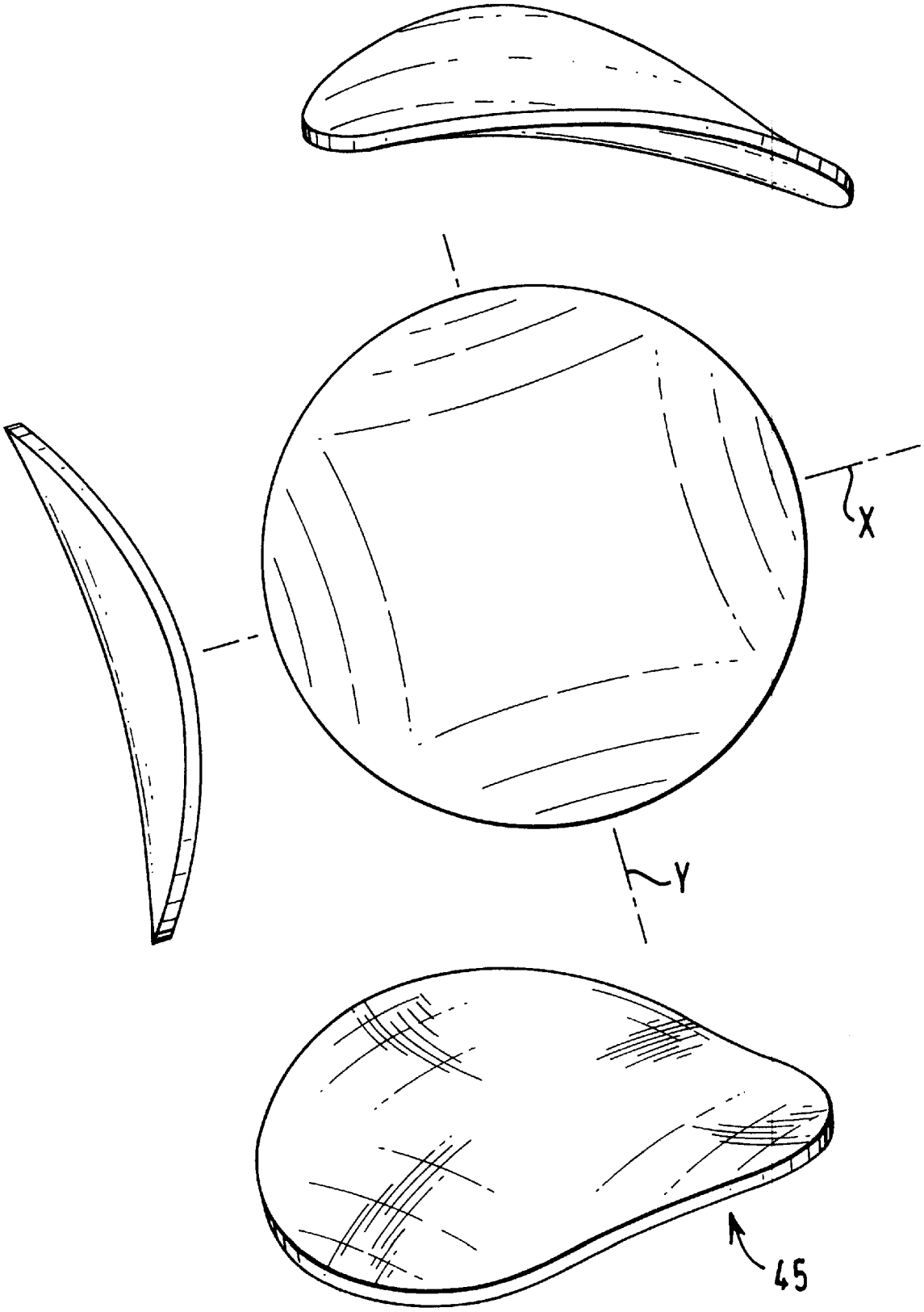
FIG. 5 illustrates the shape of the lens shown in FIG. 4.

A dual sided cylindrical lens is shown in FIG. 5, which shows four views of the same lens in different orientations. The lens is circular and has a substantially constant edge thickness. However, a first cylindrical lens is provided which modifies the horizontal height of the beam, by effectively curving the lens downwards about the X axis. Similarly, horizontal modification is provided by bending the lens upwards about its Y axis.

Thus, a 360 degree converging lens is provided by mutually perpendicular cylindrical lenses. Furthermore by being curved on opposing surfaces of the lens, the overall thickness of the lens does vary, but to a much lesser extent that that of the known comparable spherical lens, allowing it to be used in a thermally active environment.

Thus, with a light emmiting window 45 of the type shown in FIG. 5, it is unnecessary to provide a further converging lens, immediately after the emitting window, thereby reducing the number of optical elements and thereby improving optical efficiency.

Known reflectors are commonly fabricated from rhodium, aluminium or silver, having typical reflective efficiencies of 78%, 90% and 95% respectively.

As previously stated, the reflector 44 shown in FIG. 4 consists of a metallic surface integral with the heat conductive mounting 48.

Improved reflectivity may be obtained by coating the metal with a dichroic layer, which may be arranged, in addition to providing high reflectivity of desired wavelengths, to absorb undesired wavelengths which are thereby converted to heat and dissipated through the heat conductive mounting 48.

Previously, it would be undesirable to increase the amount of heat absorbed through the mounting 48, given the constaints of keeping the reflector 44 and enclosure cool. However, by greatly increasing the heat transfer efficiency through the heat conductive mounting 48, as previously described, additional heat loading may be considered. Thus, a dichroic coating may be provided on the reflector 44, arranged to absorb infrared light, whilst reflecting other wavelengths. Thus, the light reflected by the reflector 44 and directed towards the light emitting window 45 is a cool light, having wavelengths in the infrared region removed therefrom.

A dichroic coating could in addition or as an alternative, be applied to a light emitting window 45. A coating applied to said window may be arranged to absorb or reflect ultraviolet light. Thus, infrared light could be absorbed by the reflector 44 and ultra violet light absorbed by the light emitting window 45, resulting in a beam of cool visible light with very few extraneous components. Alternatively, ultraviolet light may be absorbed by the reflector and infrared light may be absorbed or reflected by the window. An an alternative arrangement, both the reflector and the window may be coated so as to remove a proportion of the ultraviolet and infrared light. Furthermore, dichroic layers could also be provided,on the reflector or on the window or on both, to adjust the colour of the light emitted by the source. In the arrangement shown in FIG. 3, coloured light is obtained by splitting a white light source, however, as an alternative, three light sources could be provided, each emitting red, green or blue light. Alternatively, the coatings could be configured to produce a beam of light at substantially any available wavelength from the arc spectrum of the gas 43.

As previously stated, the atmosphere 43 within the parabolic disclosure is essentially xenon but other materials have been added and other gases having a suitable operating temperature and pressure could be used. Alternatively metals such as sodium could be incorporated in the enclosure. In such a case some gas must be present, however, in order to initiate the discharge.

Sputtering of the tungsten electrodes may be reduced by introducing mercury into the atmosphere provided that the lamp interior is fabricated from compatible materials. Furthermore, metal halides may be introduced to introduce the spectra of the metal and the halogen. However, the introduction of such materials also has disadvantages, such as producing an unevenly coloured arc.

In a preferred embodiment, a small amount of argon is added to the xenon. The argon is effectively a dopant which increases the amount of blue light in the emitted beam. The benefits of a xenon arc lamp are retained, given that the amount of dopant is only small. For some applications, other dopants, such as neon, which increases the amount of red light generated, may be introduced.

The beam generated by the light source shown in FIG. 4 is substantially circular. However, as previously stated when using a light emitting window 45 of the type shown in FIG. 5, the cross sectional shape of the beam may be converted from circular to elliptical, with an aspect ratio consistent with that of a video image so as to improve coupling efficiency.

Modification of the beam so as to provide a substantially rectangular beam, rather than a circular or elliptical beam, may also be achieved by modifying the parabolic reflector 44 alone or in conjunction with a window lens as shown for example in FIG. 5.

In an alternative embodiment, shown in FIG. 6, looking into the front of the lamp, a substantially rectangular reflector is provided, with discontinuous facets preformed therein. In FIG. 6A, the upper surface of the reflector has 16 facets, while the lower face has eight facets. A more elegant solution is shown in FIG. 6B in which the reflector has a total of 72 facets. Parabolic facets may be used to produce essentially parallel beams having different shapes, as required for a particular application. Alternatively, beam shapes may be produced using facets having shapes other than parabolic such as elliptical or aspheric curves. The use of parabolic facets to produce a rectangular beam is one preferred option of the many possibilities.

A major disadvantage of the light source shown in FIG. 4 is that the cathode 41, the anode 42 and the central hole in the reflector 44 result in a beam being produced which has a hole at its centre, although this hole is much smaller than in prior art arrangements. Over long distances, divergence of the light tends to fill in this hole but over short distances and in the application which forms the embodiment of the present application, the central hole is undesirable.

Figure 7:
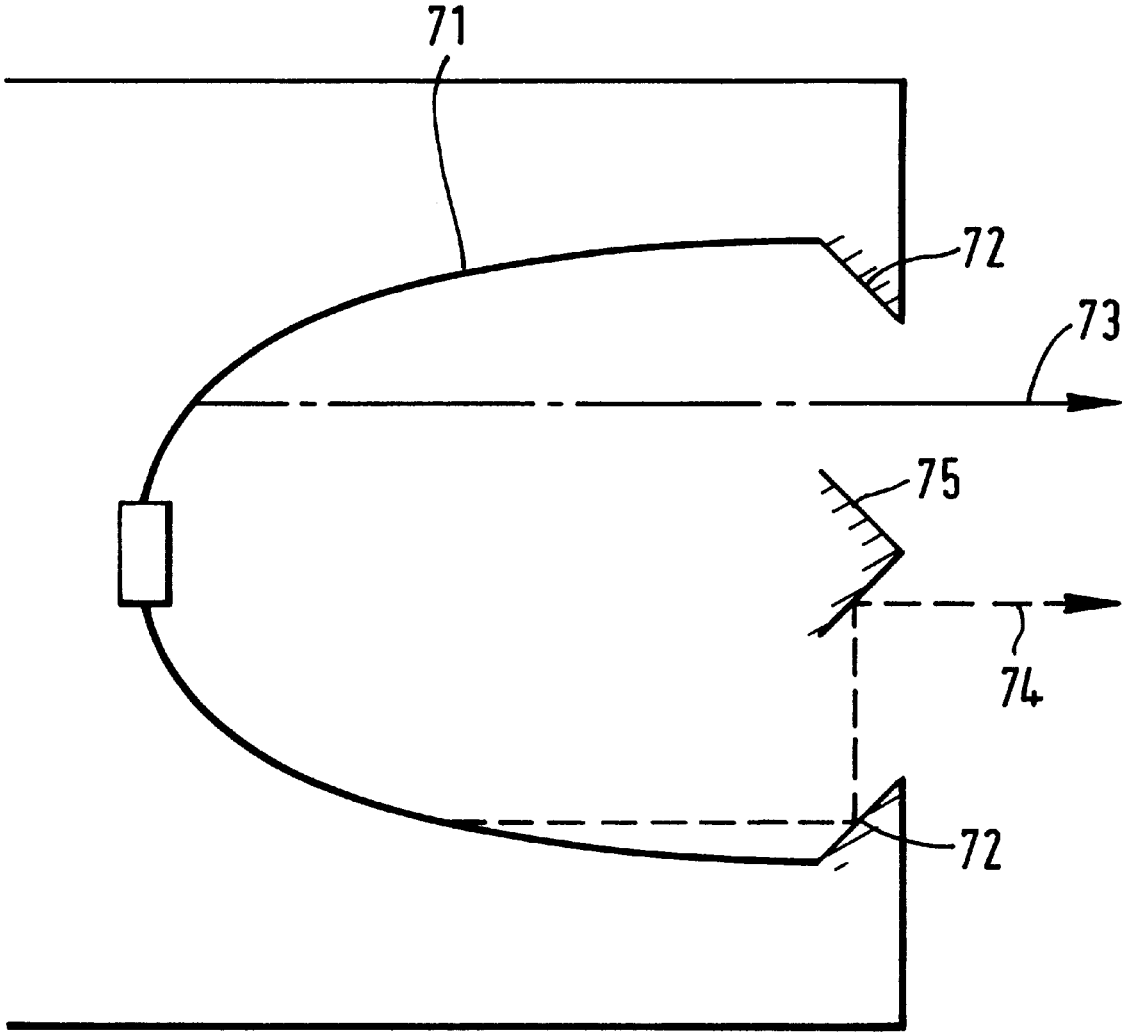
FIG. 7 illustrates an arrangement for redirecting light from the outer edge of a beam towards the centre of a beam which may be incorporated in a light source in accordance with the invention.

An alternative embodiment is shown in FIG. 7, in which the overall diameter of the beam is reduced but the central hole is filled in. Light is, for example, taken from an outer annulus of the beam and repositioned into the previously dark centre of the beam, resulting in a beam of more uniform light intensity having a reduced overall diameter. This allows smaller and more optically efficient elements to be used in the system, saving cost and gaining useful light.

For clarity, the cathode is not shown in FIG. 7, although the parabolic reflector 71 is substantially similar to reflector 44 shown in FIG. 4. At the ends of the parabolic reflector an annular reflector 72 is provided, having a reflective surface forming an angle of 45 degrees to the parallel beam reflected from the parabolic reflector 71. A light ray 73 is shown, reflected from the parabolic reflector in the normal way and forming part of the uninterrupted light beam. Light beam 74 is reflected from the parabolic reflector towards its edge and, because of this, it is reflected by the annular reflector 72 towards a conical reflector 75. The conical reflector is positioned in the region where the hole in the beam would be present and redirects light reflected from annular reflector 72 back in the direction of the uninterrupted parallel beam. Thus, peripheral light reflected from the parabolic reflector is firstly reflected by the annular ring 72 in a direction normal to the parallel beam emitted by the parabolic reflector. Thereafter, another reflector, that is the conical reflector 75, reflects the normal beam in the direction of the parallel beam, so as to reintroduce it to the parallel beam but in the position of the hole. Thus, the resulting output is a uniform parallel beam but of smaller diameter.

It will be appreciated that in principle the reflectors can be arranged to produce a non-parallel beam of light. This is, however, more complex to implement.

In the embodiment shown in FIG. 7, the parabolic reflector is circular in cross section, with a circular annular ring 72 and a conical reflector 75. In one embodiment, reflectors of the type identified as 72 and 75 in FIG. 7 arranged at an angle of about 45° to the optical axis of the lamp are provided with a substantially rectangular reflector of the type shown in FIG. 6B. Thus, an output beam may be produced which has a substantially rectangular cross section, without wasting light while at the same time having a reasonably uniform distribution of light across its cross section.

It will be appreciated that other combinations of reflectors, not necessarily at 45° to the optical axis of the lamp, may be used. By careful design the system can be arranged to take non-useful parts of the beam, and use these to infill the beam such that the efficient coupling of the arc source to the tiltable mirror devices or other spatial light modulators can be achieved.

Known arc lights, when operating in steady state, require an arc potential of about 19 volts while conducting in excess of 50 amps. However, to initiate this condition, a very high voltage is required so as to create ionisation between the anode 42 and cathode 41. Typically, a potential as great as 45 kilovolts may be required during a first few microseconds, followed by a period of several milliseconds during which about 150 volts is required, which then drops rapidly to the operating voltage of about 19 volts.

In a preferred embodiment, the arc can be initiated at the aforesaid intermediate voltage of about 150 volts, without requiring the startup voltage of up to 45 kilovolts required in prior art arrangements.

The xenon atmosphere provided within the parabolic enclosure is pre-ionised by including a radioactive isotope in the electrodes, on their surfaces or associated with the reflector. With this radio active source present, the atmosphere 43 within the enclosure is maintained in an ionised state, and arcing can be initiated with a potential of about 150 volts.

In use, radiation should not enter the environment because the devices will be returned for the reclaimation of resuable parts. Furthermore, the device does not itself emit radiation because an alpha particle emitting source is used within the enclosure, such as thorium oxide. The structure does not allow alpha particles to escape the lamp.

As an alternative to including radioactive sources within the device, a bimetallic element may be provided in the region of the cathode, which results in the cathode being brought much closer to the anode when cool. Alternatively, an additional ignition electrode may be provided, again supported on a bimetallic hinge and arranged to strike an arc and then move away from the arcing location, once warm.

As an alternative to providing a single tip, the cathode may be arranged with a plurality of very small tips, resulting in a plurality of arcs having a very small diameter. In order to maintain this configuration, the cathode may be arranged to dispense material from holes provided on the cathode surface. In any event, the tips of the cathode and anode will be in the form of small near flat ends chosen to control erosion. This can be compared with prior art light sources include electrodes having pointed tips which become flattened very quickly in operation. This leads to problems including blackening of the envelope or reflector, changes in the arc gap setting, and loss of thoria from the thoriate tungsten tip leading to a change in properties.

Figure 8:
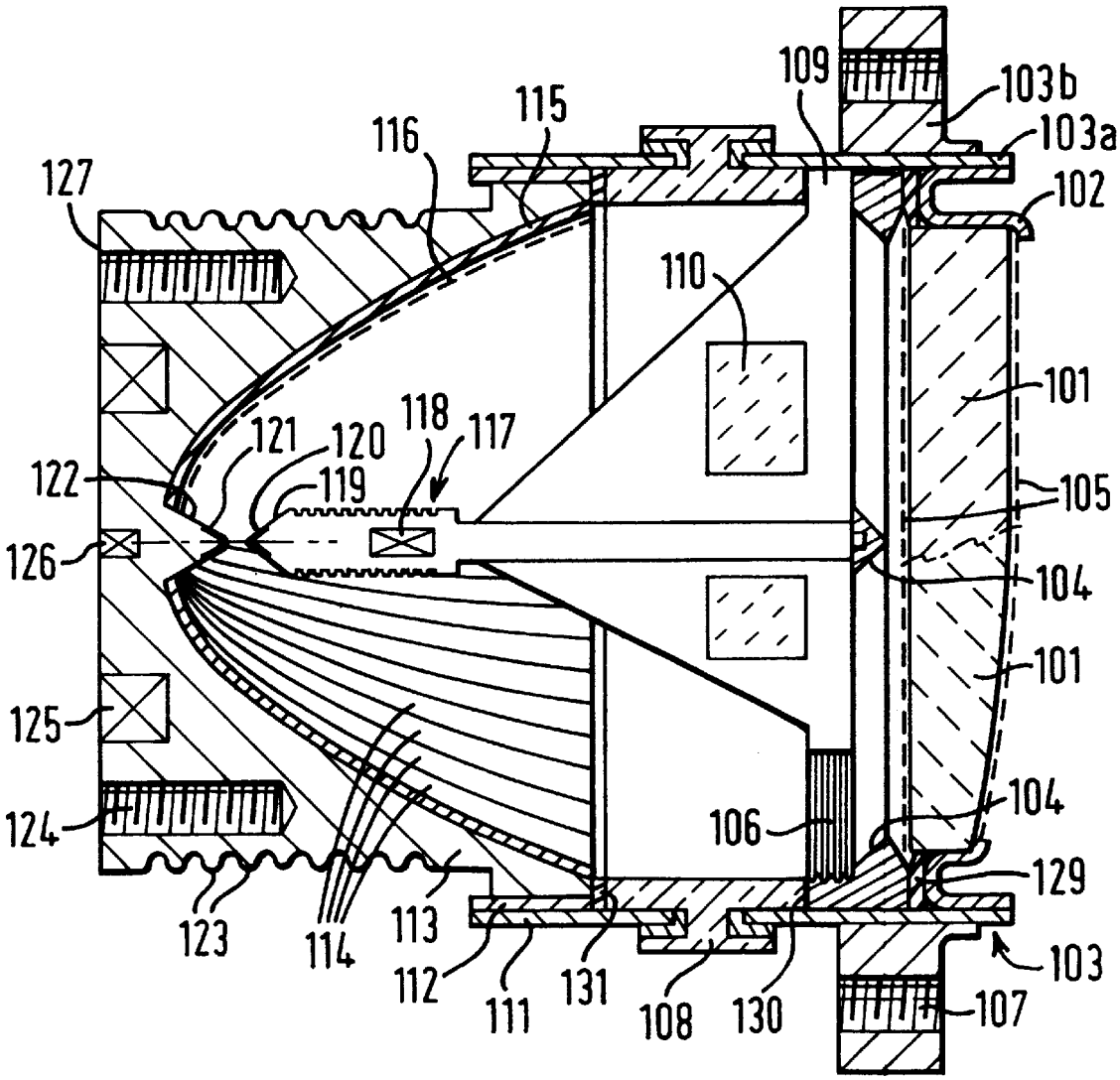
FIG. 8 shows a schematic partially sectioned side view of a light source, of the type shown in FIG. 4.

An improved light source is shown in FIG. 8, embodying the lens of FIG. 5, the facetted parabola of FIG. 6 and the light redirection mirrors of FIG. 7.

The enclosure is sealed with a window 101 formed in the shape of a lens of the type detailed in FIG. 5. The window 101 is held in place by a window retainer 102, having an anti-burst flange. A cathode flange 103 is fabricated with a ceramic matching alloy 103*a* and a copper thermal conductor 103*b*. Alternatively a high thermal conductivity tungsten/copper composite material (approximately 80% tungsten) may be used to fabricate parts 103*a* and 103*b* as a single piece. The cathode flange is electrically isolated from the anode along with its associated heat sink by ceramic body 108. The flange 103 thus provides means by which heat may be removed from the cathode.

The light source is provided with a conical reflector 104, arranged to deflect light at the periphery of the beam towards the central portion, obscured by the presence of the cathode. The window has coatings 105, which act as antireflection coatings and, possibly infrared radiation and ultraviolet radiation filtering coatings.

Fins 106 inside the cathode flange collect heat and on the outside of the cathode flange, bolt holes 107 are provided, typically six, to allow the flange to be bolted to additional supportive and heat conductive members. Between heat conductive portions connected to the anode, and heat conductive portions connected to the cathode flange, a ceramic insulator 108 is provided. In addition, the assembly has a cathode support vane assembly 109 and getters 110.

The ceramic insulator 108 connects with the anode side by means of an anode body flange 111 and the anode itself has a welding flange 112. The main housing 113 of the anode is made of copper, to provide high thermal conductivity. The parabolic reflector is made up of a number of facets 114, arranged to modify the shape of the beam, from a circular to a substantially rectangular cross section. Modification of the beam is also facilitated by the shape of the window 101, which includes two mutually offset cylindrical lenses.

The reflector includes a metallic or dichroic coating 116, arranged to reflect light including the desired wavelengths towards the window 101.

The cathode consists of a tungsten tip applied to a copper stem, the stem including cooling fins 117.

The cathode also includes a magnetic insert 118 to facilitate ignition enhancements. Ignition enhancement is also facilitated by the provision of a radioactive coating 119 on the cathode. The cathode cap 120, consisting of tungsten or doped tungsten may also include radioactive thorium, creating a radioactive environment within the enclosure, to induce ionisation prior to arc striking.

An anode cap 121 is also fabricated from tungsten or tungsten with dopants such as thorium, lanthanum, cerium etc. Further radiation may be introduced by applying a coating 122 to the anode.

The heat sink includes cooling fins 123 which could be in the form of a thread to allow attachment to further heat sink apparatus. Alternatively, screw threads 124 are provided to allow the mounting of the device and the connection of further heat sinks.

A magnet 125, which may be a permanent magnet or an electromagnet, shown in cross section in FIG. 8, provides an axial magnetic field in the direction between the anode and cathode which will be concentrated by inserts 118 and 126 if these are fitted. The inserts 118 and 126 will generally be formed from soft magnetic material. The magnet field thus produced will act as a focussing field, reducing the diameter of the arc as the electrons will tend to travel along the direction of the field. Furthermore, the magnetic field also improves arc striking by directing ions towards the cathode tip. The concentrating effect of the inserts 118,126 will only take place the as long as the temperature of the inserts is less than their Curie temperature. This will ensure broadening of the arc and protection of the electrodes if the temperature rises too high as a reversible protective method.

Furthermore, where the magnet 125 is a permanent magnet, this is advantageously arranged to have a Curie temperature such that in the event of serious overheating, the magnetic field produced by the magnet 125, in conjunction with inserts 118,126, will reduce, thus broadening the arc and reducing the loading on the electrode, i.e. ensuring a failsafe operation. Alternatively where the magnet 125 is an electromagnet, this is probably built into the lamp rather than being an add-on so as to ensure alignment. It is also possible to arrange for such an electromagnet to be switched off in the event of serious overheating of the lamp in order to achieve electrode protection.

Figure 9:
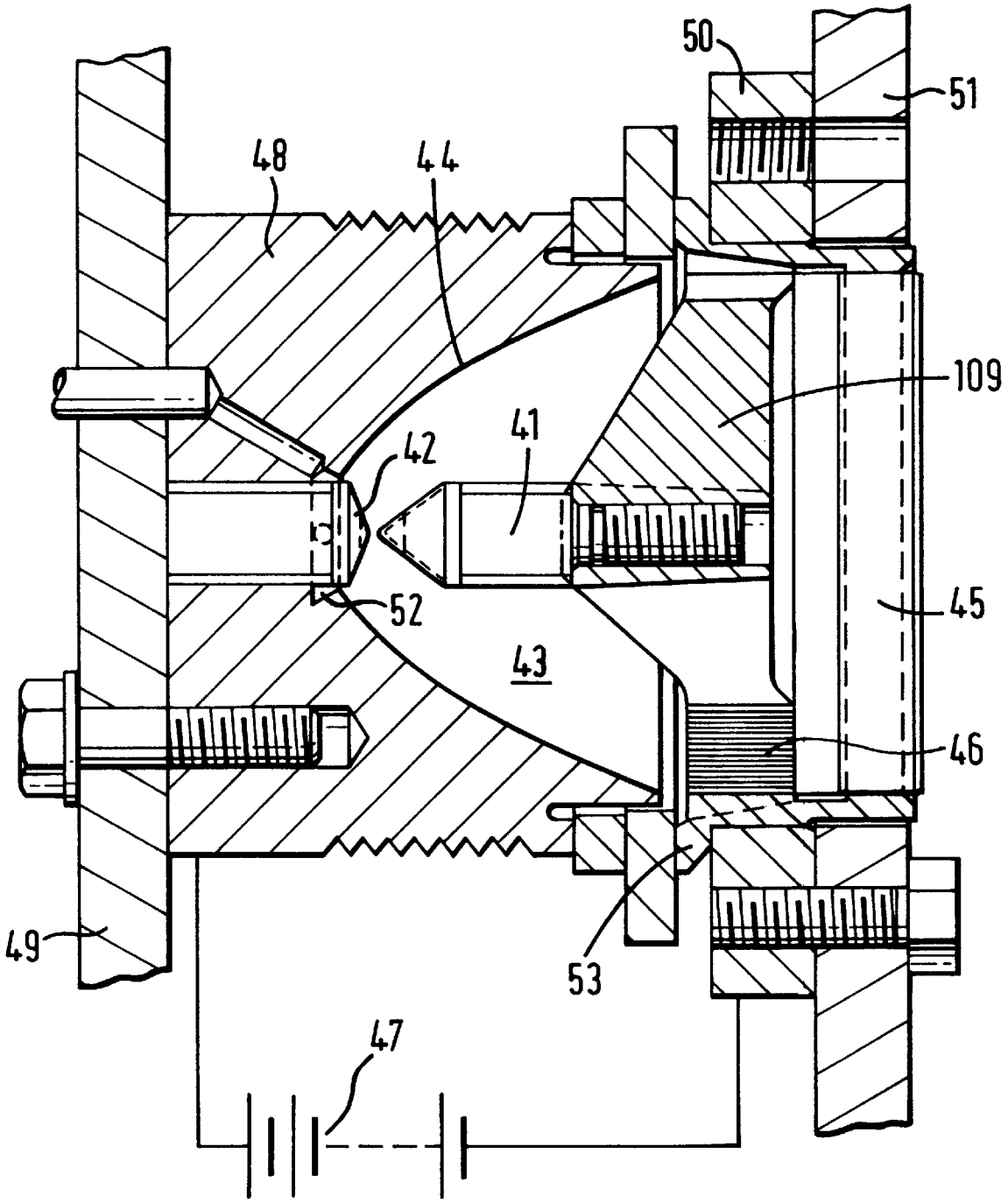
FIG. 9 shows an alternative schematic partially sectioned side view of a light source of the type shown in FIG. 4.

Turning now to FIG. 9, this Figure shows a development of the light source of FIG. 4. Corresponding features to those of FIG. 4 are correspondingly labelled in FIG. 9. In the embodiment of FIG. 9, a single component 53 formed from a ceramic matching alloy such as kovar replaces parts 102,103*a*,106,107 and 109 in the embodiment of FIG. 8 with a single component. Furthermore, by using a tungsten/copper composite material, it is possible to incorporate part 103*b* and to improve substantially the thermal performance of the front structure of the light source. It is also found that there is a significant cost saving in either the kovar part 53 or the tungsten/copper part since many assembly stages are avoided. It will be appreciated that the cathode support pillar can in principle be integrated into the tungsten/copper composite component, thus eliminating most of the individual parts in front of the light source. This leads to benefits in cost and design.

It will also be seen in the embodiment of FIG. 9 that in order to avoid the need for a pumping hole in the reflector 44, an annular recess 52 may be provided slightly increasing the size of the hole in the reflector.

The cathode support vane 109 shown in FIG. 8 will typically comprise three straight flat strips of a refractory metal, such as molybdenum, jig assembled and brazed for example with copper. As the strips are typically 5 mm wide in the prior art arrangements, the support vane has limited resistance to sideways movement of the cathode and thus the strips of the embodiment of the invention have been broadened in order to improve this.

Figure 10:
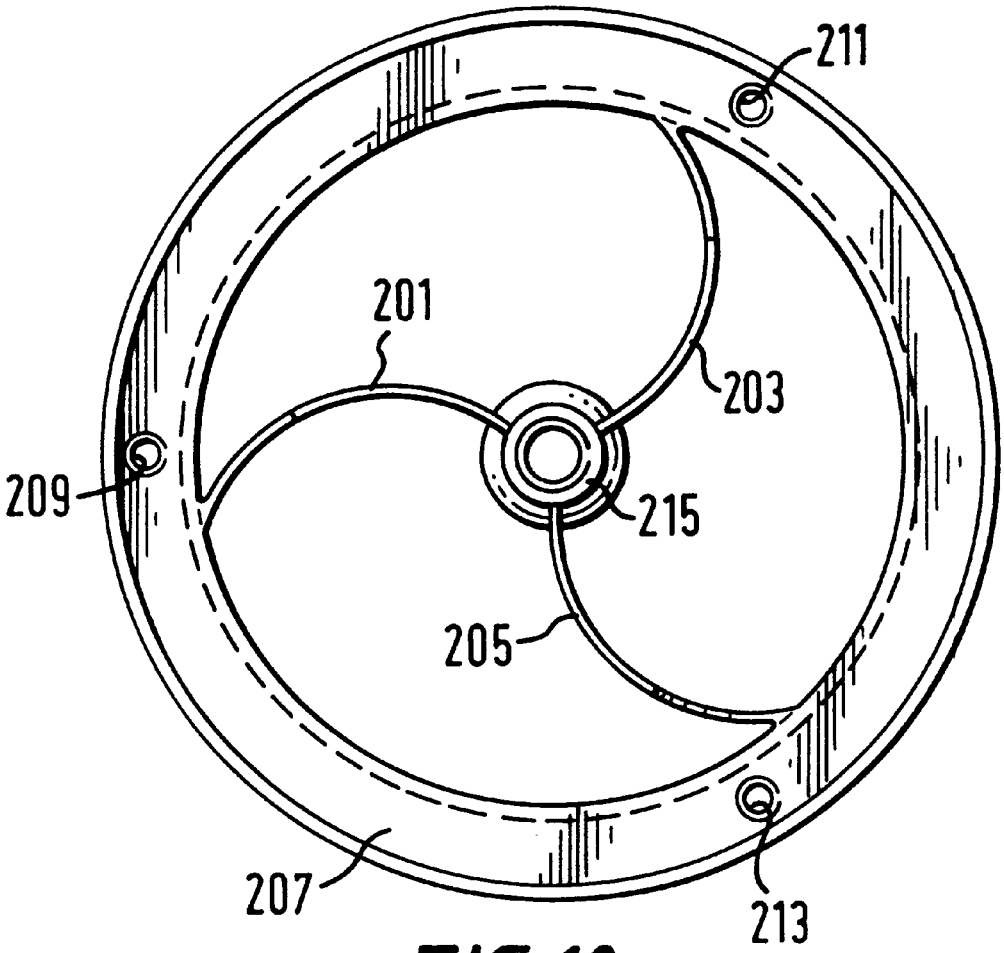
FIG. 10 is a schematic plan view of an alternative cathode support vane for incorporation in a light source of the type shown in FIGS. 4, 8 or 9.
Figure 11:
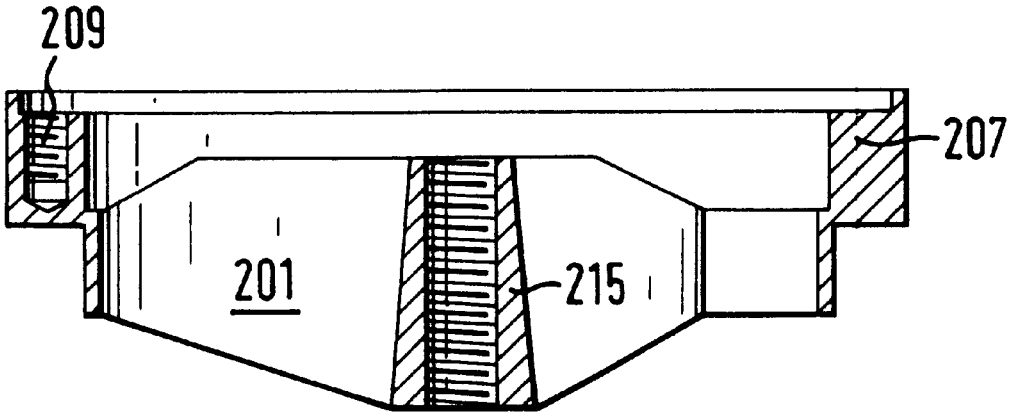
FIG. 11 is a side view of the cathode support vane of FIG. 10.
Figure 12:
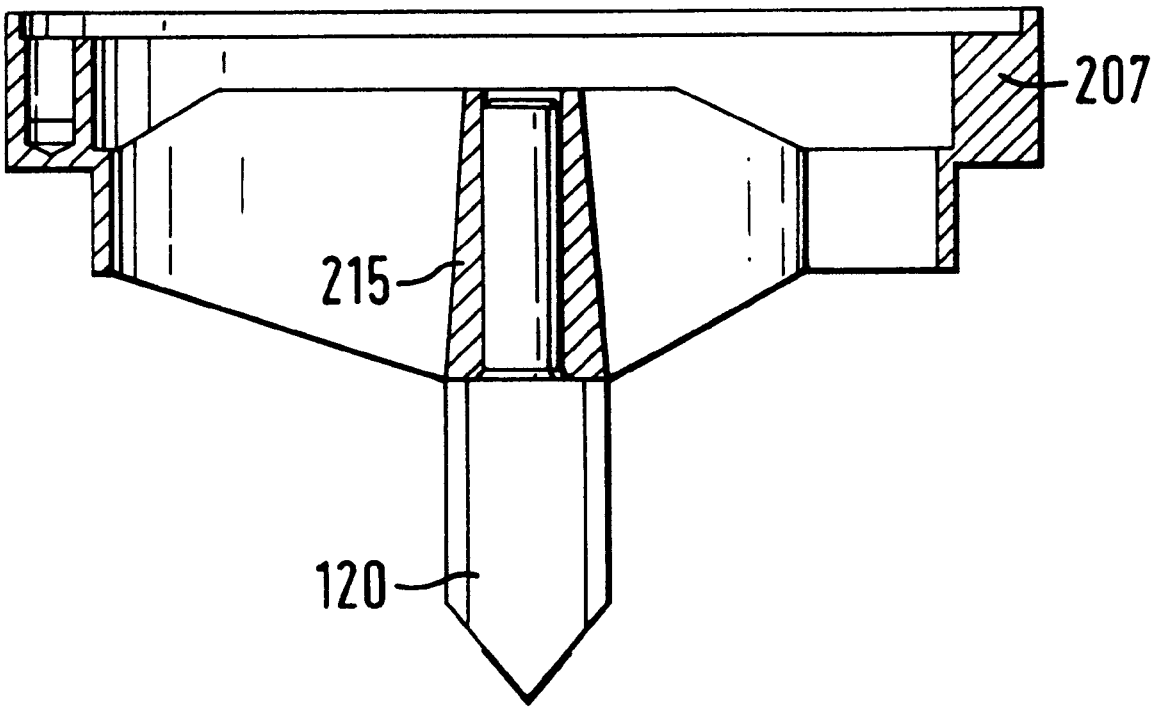
FIG. 12 is a side view of the cathode support vane of FIG. 10, corresponding to the view of FIG. 11 but incorporating an electrode.

Turning now to FIGS. 10,11 and 12, these Figures illustrate a form of cathode support vane which may be used in the light sources of the type shown in FIGS. 8 and 9. The cathode support vane is formed with three curved strips 201,203,205, typically 0.3 mm wide and 17 mm deep. The strips have a wider portion at their outer edge which is integral with a collar 207 at the periphery of the vane. The collar 207 has three screw holes 209,211,213 to enable attachment of the vane via respective screws (not shown) to the cathode heat sink in the apparatus for operating the lamp. Thus the periphery of the vane is outside the light source enclosure shown in FIG. 8.

Turning now particularly to FIGS. 11 and 12, formed from the centre of the vane is a conical boss 215 designed so as to minimise obstruction of light from the reflector 114. The magnetic material insert 118 shown in FIG. 8 may, in use of the vane, be carried in the cavity formed in the boss which can itself also be a magnetic material. As indicated in FIG. 12, the cathode 120 is typically, in use of the vane, attached to the boss 215 by means of matching screw threads formed on the cathode 120 and boss 215, and brazing or some other permanent securing means. If required, spacers may be inserted between the cathode 120 and the boss 215 to achieve the correct assembly dimensions. Preferably, however, an allowance is made during manufacture so as to enable the cathode 120 to be machined to the precise height in the sub-assembly so that the use of spacers, with their inherent inaccuracies, can be avoided.

The cathode support vane shown in FIGS. 10, 11 and 12 including the strips 201,203,205, collar 207 and boss 215, may be formed from a solid block of metal by machine turning, followed by electrical discharge machining or "spark eroding".

It will be appreciated that by the substitution of the deep, curved, triangular strips 201,203,205 for the prior art straight strips, a stronger, more rigid, and more temperature stable support is produced for the cathode 215. The strips 201,203,205 can have a reduced cross section relative to those of prior art vanes having equivalent strength, thus reducing beam obstruction. The curves in the strips 201, 203,205 allow expansion movements to be taken up by rotation of the cathode 120, rather than causing an uncontrolled movement or bending of the cathode as in the prior art arrangements. Thus axial alignment of the cathode 120 is maintained. It will be appreciated that whilst the strips 201,203,205 have an arcuate form, the strips may take any form which, in the event of thermal expansion, produces a turning moment on the cathode.

It will be appreciated that by use of a support vane as shown in FIGS. 10, 11 and 12, thermal conduction to the lamp body is improved. Furthermore, as the strips are not brazed but formed in one piece with collar and bush the operating temperature limit is raised. As the collar 207 has a greatly increased surface area relative to the prior art arrangement by virtue of its method of manufacture an improved heat sink function from the Xenon gas to the collar 27 is achieved.

It will be appreciated that the use of a non-refractory metal, such as mild steel gives a considerable cost advantage to the modified vane. Refractory metals, such as molydenum may however be used if required. Furthermore, the method of manufacture from a solid block saves a substantial amount of time and processing as the method inherently aligns the cathode in the centre of the support vane.

It will also be appreciated that whilst three support strips are shown in FIG. 10, in practice two, or more than three support strips may be incorporated in the support vane.

It will be appreciated that in all the examples described herebefore the anode is fixed within a heat sink, whilst the cathode is suspended within the lamp enclosure. This is a conventional arrangement in so much as the power dissipation requirements of the anode are greater than those of the cathode. In view of the enhanced temperature dissipating abilities of a light source in accordance with the invention however, it is possible to make the anode the suspended electrode, with the cathode becoming the fixed electrode whilst, still maintaining reasonable anode temperatures. The benefit of such an arrangement is that the primary life limiting factor of a light source used in a projector is the movement of the hot spot at the tip of the cathode as the cathode erodes. The tip of a blunt, well cooled cathode enabled by causing the cathode to be the fixed electrode, will have a much lower erosion rate than the tip of a suspended cathode. Whilst there will be a reduction in efficiency of anode heat dissipation by such a reversal of anode and cathode, this will be much less of a problem than in prior art arrangements. Thus the electrode reversal will offer a substantial gain in light source life. It will be appreciated that in order to adapt the light sources for example as shown in FIGS. 4, 8 and 9 it is necessary only to reverse the polarity of the power supply 47 connected to the two electrodes, and in some configurations to interchange the electrode materials.

What is claimed is:

1. A light source in the form of a sealed beam arc lamp comprising a cathode and an anode defining between them an arc gap, and a reflector, said anode and cathode being arranged within the reflector, said reflector being formed on the surface of a metallic heat conductive mounting, and one of the cathode and the anode being thermally connected to the heat conductive mounting.

2. A light source according to claim 1, wherein said heat conductive mounting is fabricated from a heat conductive metal chosen from copper, silver, or composite materials including copper or silver, and tungsten.

3. A light source according to claim 1 further comprising a magnetic field generation means in the vicinity of the arc gap comprising an annular magnet coaxial with the mounted electrode, and at least one magnetic insert in at least one of the mounted and suspended electrodes, wherein said magnetic field generating means is arranged to generate an axial magnetic field in the direction between the anode and the cathode.

4. A light source according to claim 1 further comprising a magnetic field generation means in the vicinity of the arc gap, the magnetic field generation means having a magnetic field which decreases with an increase in temperature so as to increase the size of an arc in the arc gap in the case of overheating of the lamp.

5. A projection system including a light source according to claim 1.

6. A light source according to claim 1, in which the reflector carries a dichroic coating effective to selectively transmit infrared radiation.

7. A light source according to claim 1, in which the other of said anode and cathode which is not thermally connected to the heat conductive mounting includes a structure formed with a surface texture so as to increase the surface area of said other of the anode and cathode.

8. A light source according to claim 7, in which the surface texture is a grooved structure.

9. A light source according to claim 1, wherein at least one of said cathode and anode is fabricated from tungsten at its active surface in thermal contact with a heat conductive material forming a heat conductive path from the active surface extending substantially along the length of said cathode or anode.

10. A light source in the form of a sealed beam arc lamp comprising an anode and a cathode, and a reflector forming at least part of the enclosure for the arc lamp wherein at least one of said cathode and said anode is fabricated from tungsten at its active surface in thermal contact with a heat conductive material comprising at least one of copper and silver forming a heat conductive path from the active surface and extending substantially along the length of said one cathode or anode.

11. A light source according to claim 10, in which said one cathode or anode is fabricated from a tungsten rod, including a hollow section extending substantially along the length of the rod, said heat conductive material filling the hollow section.

* * * * *